United States Patent [19]

Philipp

[11] Patent Number: 5,055,827

[45] Date of Patent: Oct. 8, 1991

[54] FIBER OPTIC SECURITY SYSTEM

[76] Inventor: Harald Philipp, 4885A McKnight Rd. #283, Pittsburgh, Pa. 15237

[21] Appl. No.: 482,089

[22] Filed: Feb. 20, 1990

[51] Int. Cl.[5] ..... G08B 13/14

[52] U.S. Cl. ..... 340/568; 340/555; 455/612; 385/13

[58] Field of Search ..... 340/568, 555, 556, 557, 340/572, 600; 350/96.29, 96.15; 24/115 G, 136 L; 403/208, 215; 455/612

[56] References Cited

U.S. PATENT DOCUMENTS

| | | | |
|---|---|---|---|
| 4,592,116 | 6/1986 | Christensen | 24/115 G |
| 4,633,235 | 12/1986 | DeGennaro | 340/568 |
| 4,654,640 | 3/1987 | Carll et al. | 340/568 |

*Primary Examiner*—Reinhard J. Eisenzopf
*Assistant Examiner*—Geoff Sutcliffe
*Attorney, Agent, or Firm*—Russell W. Illich

[57] ABSTRACT

An optical security system is disclosed for one or more appliances such as a network of computers, terminals, and associated peripheral devices. The system comprises an optical fiber cable that is attached to an appliance through attachment devices that are secure from physical attack. The ends of the optical fiber are connected to a control box to form an optical fiber circuit which senses the amount of light within the fiber at any given time. The alarm device sounds if light within the fiber cable is attenuated through bending or breaking of the fiber cable in an attempted theft of the secured computer. The attachment devices comprise a two piece unit which holds the optical fiber. The first piece is a solid cone that is fastened to the computer component by a screw or adhesive. The second piece is a hollow cone that fits entirely over the solid inner cone. The cones include slots for holding the optical fiber between the cones. The fiber is held by the cones but is able to slide within the cones without breaking or bending the fiber cable. This allows the computer component to be moved without setting off the alarm. The alarm activates only when someone attempts to pry or pull the cones apart, subsequently bending the fiber cable.

15 Claims, 3 Drawing Sheets

Fig. 3
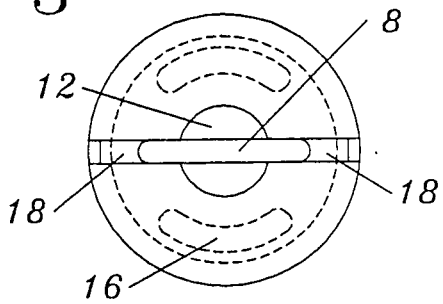
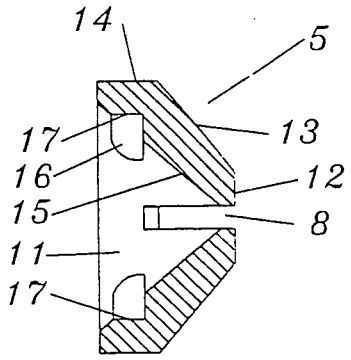
Fig. 4
Fig. 5
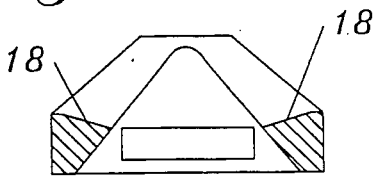
Fig. 7
Fig. 6
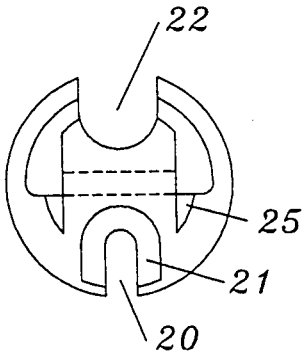
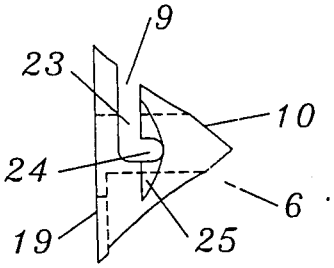
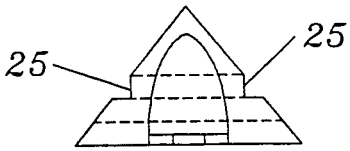
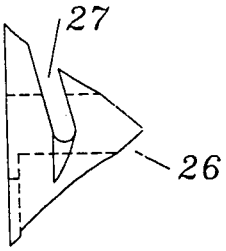
Fig. 8
Fig. 9

FIBER OPTIC SECURITY SYSTEM

BACKGROUND OF THE INVENTION

The present invention relates to a security system for protecting one or more otherwise unsecured appliances. One specific application of the system is to protect a plurality of personal computers and their associated peripherals. In the past, security systems for personal computers have been comprised primarily of external alarms and locks which can be defeated by many potential thieves. The external nature of the wires of an alarm allow a thief to defeat the security system before the alarm can sound. In security systems involving locks, a physical attack on the lock or any chain or cable can allow a thief to defeat the security system. There has been a long felt need within the field of personal computers and office equipment to secure one or more pieces of equipment in an efficient and fail-safe manner, and provide an alarm indication of tampering or attempted theft.

One solution to the past failure of computer and office equipment security systems ("appliances") involves the use of fiber optic cable that allows a beam of light to be transmitted through its length. A thin fiber cable through which a light shines is attached to one or more appliances; the ends of the fiber optic cable are connected to an alarm system mounted at a remote location. If a potential thief cuts the fiber cable to release the individual appliance from the fiber optic security system, the remote alarm sounds upon sensing the broken light circuit. This system resolves the difficulty in preventing a thief from cutting, splicing, or bypassing normal electrical wires in defeating an alarm system.

One disadvantage of such an optical fiber security system is that the system is still susceptible to physical defeat at the node where the optical fiber cable is attached to the appliance. If a thief removes the attachment device at the node from the appliance without cutting the optical fiber cable, the alarm system is defeated. It is generally known within the prior art of security devices that a system is only as strong as the weakest link within the entire system. In this case, the weakest link is the possibility of physical defeat at the nodes. Therefore, a system is needed to allow the use of a simple optical fiber network to secure a plurality of computers or peripherals without the possibility of attack at the nodes of the system.

Another disadvantage of existing fiber optic security systems is that they generally require that the optical fiber be secured through an attachment device that requires that a cut end of the optical fiber be threaded through the device In situations where long optical fibers are employed, this generally means that in order to conveniently and legitimately move, remove, or add a particular appliance from or to the fiber loop, the fiber itself must be cut so that a long length of fiber need not be threaded through a large number of other attachment devices mounted on other appliances. In fact, manufacturers of such systems (e.g. those produced by Minatronics of Pittsburgh, Pa., USA) generally specify that the fiber must be periodically cut and spliced together. Such splices introduce signal loss thereby reducing the permissible optical fiber length, and also require installation time in addition to raising the material costs of the system. The impetus to eliminate splices requires that a new attachment device be devised to permit the optical fiber to be attached or removed from an appliance without the need for threading through long lengths of fiber.

Another disadvantage of existing security systems is that fiber attachment devices presently used do not allow sufficient flexibility to permit attachment to a large variety of appliances, and do not adequately secure the appliance from being opened. For example, a fiber attachment device that employs a screw to mount it onto an appliance may not be mountable on an appliance that has no screw holes, or that requires a screw of a different size or thread. In such a situation, drilling into the appliance is usually required, an act that usually voids manufacturer's warranties or could cause serious damage to the appliance itself. In another example, an existing form of attachment device may be mountable on an appliance but only in a way that still permits the appliance to be opened. A computer with deeply recessed enclosure fastening screws unusable for mounting the attachment device may be opened by a thief and its computer boards removed, even with an attachment device securely fastened elsewhere to the outside of the case. These circumstances suggest a need for a new form of attachment device that permits enhanced flexibility in its mounting on appliances.

SUMMARY OF THE INVENTION

It is an object of this invention to provide an optical security device that includes an optical fiber cable which is connected to one or more appliances to form a light circuit and uses a remote device to sense whether the circuit is cut and subsequently sound an alarm.

Another object of the invention is to provide an optical security device that senses whether the optical fiber cable is merely bent in an attempt to steal the appliance.

It is a further object of the invention to provide an optical security device that is secure from physical attack at the attachment nodes of the system, yet economical and practical to manufacture and attach.

Yet another object of the invention is to provide the ability to attach or remove an optical fiber from its mounting on an appliance without the need to cut or disconnect the optical fiber itself.

A further object of the invention is to permit enhanced flexibility in attaching the optical fiber to an appliance, in such a manner as to not require drilling of the enclosure of the appliance.

Another object of the invention is to permit the mounting of the optical fiber on an appliance in such a manner as to prevent the unauthorized opening of the appliance in order to gain access to internal components of the appliance.

Other objects of the invention will be apparent hereinafter from the specification and from the recital of the appended claims, particularly when read in conjunction with the accompanying drawings.

The present invention comprises an optical security system for one or more appliances. The system comprises an optical fiber cable that is attached to one or more appliances, such as a computer, through node attachment devices that are secure from physical attack without bending or breaking the fiber cable. The ends of the optical fiber are connected to the remote alarm which senses the amount light within the fiber at any given time. The alarm device sounds if light within the fiber cable is attenuated due to bending or breaking of the fiber cable in an attempted theft of an appliance. The attachment devices comprise a two piece unit which holds and attaches the optical fiber to an appliance. The first piece is a relatively solid cone that is fastened to the appliance or computer component by a screw, adhesive, or other fastening means. The second piece is a hollow cone that fits entirely over the more solid inner cone. The cones include slots for holding the optical fiber between the cones. The fiber is held by the cones but is able to slide within the cones without breaking or bending the fiber cable; this allows an appliance to be moved without setting off the alarm. The alarm activates only when someone attempts to pry or pull the cones apart, subsequently bending the fiber cable. In prying the cones apart, the fiber is not ordinarily broken; rather, a sharp bend is introduced that severely attenuates the light signal sufficient to activate the alarm.

BRIEF DESCRIPTION OF THE DRAWINGS

FIG. 3 shows a top plan view of the outer cone of the security device.

FIG. 4 shows a cross-sectional view along the line A—A of FIG. 3.

FIG. 5 shows a side plan view along the line B—B of FIG. 3.

FIG. 6 shows a top plan view of the inner cone of the security device.

FIG. 7 shows a side plan view along of FIG. 6.

FIG. 8 shows a front plan view along of FIG. 6.

FIG. 9 shows a side plan view of a second embodiment of the inner cone.

DETAILED DESCRIPTION OF THE INVENTION

Figure 1:
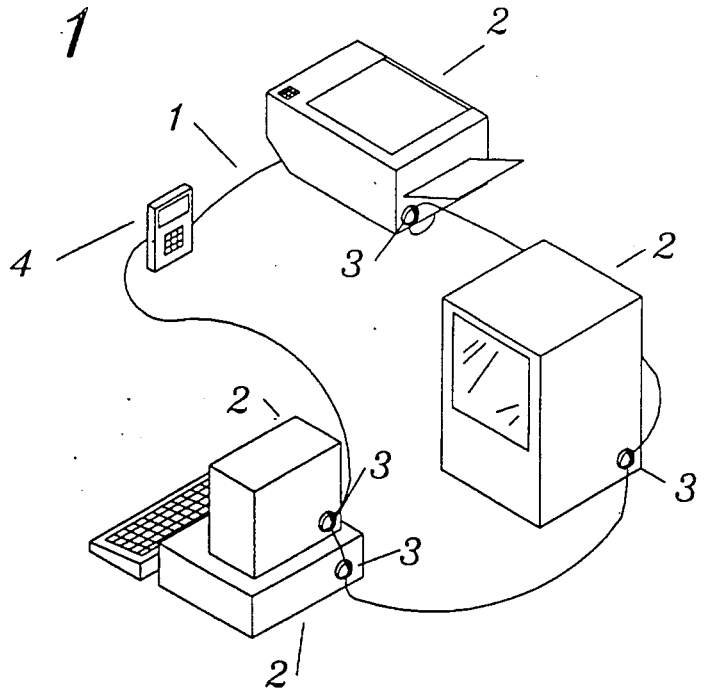
FIG. 1 shows a schematic of the optical security system of the present invention connected to a network of computers and associated peripheral devices.

FIG. 1 shows a preferred embodiment of a schematic of the present invention when used to protect personal computer equipment. The optical security system involves the use of an optical fiber cable 1 that is made of a flexible material such as plastic that can be cut to any length. The fiber cable is of a relatively thin nature and allows light to pass therethrough. The optical fiber cable is connected to a network of computer components 2: the computer itself, a monitor, a printer or any other computer peripheral or appliance. The connection of the optical fiber cable 1 to the computer components 2 is achieved by nodes attachment devices 3 which use the inner and outer cones to secure the fiber cable therebetween. The ends of the fiber cable are remotely connected to a control box 4. The control box includes a light source to shine light through fiber cable 1, a sensing device to detect if the light circuit is broken through the bending or breaking of the fiber cable, and an alarm device for sounding an alert in response to the sensing device. The system may include many other conventional security features such as password control of the alarm and remote camera/television control; it may also be connected to a master alarm system within the office or building where it is installed.

Figure 2:
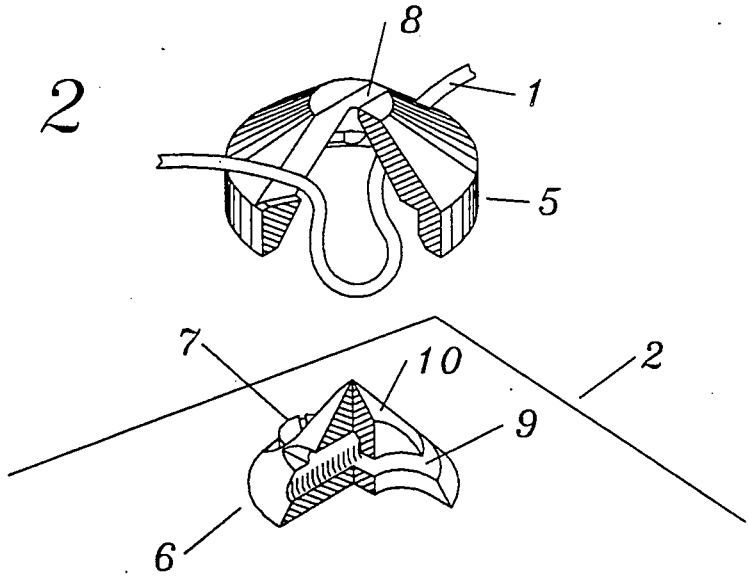
FIG. 2 shows a partially cutaway perspective view of the inner and outer cones which make up the node attachment device portion of the system.

FIG. 2 shows a detailed perspective view of the attachment device portion of the system which is meant to attach the optical fiber cable 1 to the computer component 2. The device includes an outer cone 5 that slips over an inner cone 6.

In one method of mounting, the inner cone is attached to a computer 2 by a screw 7. Installation costs and effort can be minimized by using a screw already provided on the housing of the appliance. This method of installation can also secure the internal components of, for example, a computer. Since the head of the screw becomes hidden by the outer cone 5 when assembled, the computer housing cannot be opened without first removing the outer cone, resulting in bending of the fiber and thus an activation of the alarm. Thus, valuable interior parts of a computer component such as microchips, disk drives, etc. may be protected by using this security system.

The outer cone 5 is of a hollow configuration designed to fit over the relatively solid cone 6. To assemble the device with the fiber cable, the alarm control box 4 is initially turned off. A portion of the optical fiber cable 1 is bent into a U-shape as shown in FIG. 2 and inserted through a diametric slot 8 extending across outer cone 5. Care should be taken to ensure that enough slack is formed within the fiber cable extending out of the hollowed portion of cone 5. The loop of fiber cable 1 is subsequently hooked into a radial slot or groove 9 extending into the inner cone 6. Once the loop is inserted into the end of radial groove 9, the outer cone 5 is pushed down along the fiber cable 1 and onto the inner cone 6. As the outer cone nears the outer peripheral surface 10 of cone 6, the fiber cable 1 becomes pinched until the lowest portions of slot 8 come into alignment with radial groove 9. Upon alignment of the slots, the flexible nature of the fiber cable allows the fiber cable to rebound to its original shape which allows the normal, full amount of light to shine therethrough. The fiber cable 1 is also able to freely slide through the inner and outer cones once assembled.

As can be seen, the fiber cable 1 itself not only is captured by the assembly of the inner and outer cones, but itself also holds and locks the outer cone onto the inner cone. No other fastener between the inner and outer cones is required, and the outer cone cannot be removed without either first unthreading the optical fiber to remove it from between the cones or physically prying the outer cone off of the inner cone.

Once the optical fiber cable is assembled between the cones, the alarm is ready to be activated and used. It should be noted that the device may be disassembled in the exact reverse steps of the assembly process. However, if a potential thief were to attempt such a disassembly of the cones while the alarm is activated, he/she could not avoid a pinching or bending of the fiber cable when removing the outer cone from the inner cone. The sensing device of the control box 4 detects an attenuated light circuit upon the breaking or pinching of the fiber cable 1, and sends out an alarm signal.

FIGS. 3–5 show details of the outer cone 5. The primary parts of the cone include a slot 8 within the outer peripheral surface through which the optical fiber cable extends and a hollow cavity 11 on the interior side of the outer cone which covers the outside of the inner cone.

The outer cone comprises an outer peripheral surface that is divided into three subsurfaces. The first is a circular and flat top surface 12. A flat surface prevents the snagging of clothes or injury to a person using the appliance over a pointed or peaked cone. The second outer peripheral surface is the outer conical surface 13. This surface gives the cone its overall shape which covers both the inner cone and a portion of the optical fiber cable. The final surface is an outer cylindrical surface 14 which abuts a surface of the computer component or appliance. This surface protects the edge of the inner cone from attack by a potential thief. Any action to get at the inner cone from the edge of the cylindrical surface 14 will cause the outer cone to slide up on the inner cone thereby sounding the alarm when the optical fiber cable gets pinched between the cones.

The inner peripheral surface 15 is conical in its entirety with the exception of a pair of kidney shaped cutouts 16 which extend upon two sides of the surface 15. The cutouts include a cylindrical surface 17 which allows for the head of a mounting screw that fastens the inner cone to a surface of the protected appliance. Two cutouts are used so that the part is symmetrical, obviating the need for an installer to take precautions in orienting the outer cone with respect to the inner cone and any protruding screw head holding down the inner cone. Other than the provision for space for the screw, the entire inner peripheral surface 15 matches and totally covers the outer surface of the inner cone.

The slot 8 extends across the entire width or diameter of the outer cone. Although the slot extends across the entire diameter of the outer cone, FIG. 3 shows that the opening of the slot to the hollow cavity is somewhat shorter than the diameter because of side ramps 18 that define the bottom of the slot 8. The purpose of the side ramps is to provide a free but slightly bent path through which the optical fiber cable extends. Introducing a slight bend in the fiber as it travels through the device causes the light in the fiber to attenuate more rapidly with small displacements of the outer cone. When the outer cone is in secured position over the inner cone, the optical fiber cable slides with only slight friction across the ramps 18, allowing the appliance to be moved along a desktop or countertop without triggering the alarm.

FIGS. 6–8 show details of the first embodiment of the inner cone 6. The inner cone is a relatively solid piece and includes an outer peripheral surface 10 that is conical in shape. The cone also includes a base surface 19 that is mounted against a surface of an appliance by a screw.

In another mounting option, the inner cone is mounted on the surface of an appliance in a manner similar to that shown in FIG. 2, except that instead of a screw 7 an adhesive such as a cyanoacrylate or epoxy is applied between the base 19 and the appliance surface. This method of mounting is most useful when the appliance does not have a convenient mounting screw on which to attach the device.

The inner cone includes a pair of cutouts on two opposite sides of the cone as best seen in FIG. 6. The first cutout 20 is formed as a slot through which a threaded shaft of a screw may extend. A flange 21 surrounds the slot to accommodate the head of screw which is used to tightly secure the inner cone 6 to an appliance. As can be seen, cutout 20 is open to obviate the need to completely remove a screw from a housing prior to affixing the device. The slot could also be closed on its open end to create an internal cutout; such a modification would make it more difficult to detach the device from the appliance by simply hammering on it in such a manner as to cause the device to slip out from under the screw head. However, outer cone 5 also acts to shield the screw head laterally and will tend to block such a forced removal of the device.

The second cutout 22 is disposed opposite cutout 20. Many appliances have housings that are fastened together with screws disposed within recessed portions of the housings. While such screws are not generally useful in mounting the device onto the appliance, it is important to allow the device to be mounted over such recessed screws to prevent unauthorized opening of the appliance. Cutout 22 is designed to allow the device to be positioned over such a recessed housing screw while maintaining access to such a screw when the outer cone is removed from the inner cone. In such cases the device is typically mounted on the appliance with an adhesive and is not conveniently removable; with this feature the inner cone need not be removed at all in order to gain normal and legitimate internal appliance access.

The radial groove 9 of the inner cone 6 is comprised of a longitudinal portion 23 which extends toward the center of the cone and a transverse section 24 which extends toward the peak of the cone. The transverse section of the slot is where the optical fiber cable resides when the outer cone is pushed onto the inner cone. The lower surface of the optical fiber running through the transverse section of the slot at 24 is at a height even with the inner parts of the ramps 18 of the outer cone as shown in FIG. 5, to allow the optical fiber cable to freely slide through both the inner and outer cones when assembled. When the outer cone is assembled with the optical fiber onto the inner cone, the ramps 18 of the outer cone prevent the fiber from being lowered and manipulated out via the longitudinal slot 23. The vertical walls of the slot at 24 also act to capture the fiber so as to prevent its being worked or slipped out.

The final feature of the inner cone is a semi-circular recess 25 as seen in FIGS. 6, 7, and 8. This recess surrounds the opening of the transverse section 24 of groove 9, and effectively provides the optical fiber a small gap of free space between the inner and outer cones so that it can bend and not simply shear off or become damaged when the outer cone is inserted or removed from the inner cone. It also permits the optical fiber to bend between the inner and outer cones when the outer cone is merely rotated rather than pulled off, for the same reasons. If a thief attempts to rotate the outer cone to remove it from the appliance, the optical fiber will thus bend a sufficient amount to set off the alarm.

A second embodiment of the inner cone is shown in FIG. 9 and is substantially similar to the first embodiment. Only the differences of the second embodiment from the first embodiment will be addressed herein. The inner cone 26 has a radial slot 27 that extends at a diagonal to the base of the cone toward the peak of the cone. The end of the diagonal slot houses the optical fiber cable in assembled form. The slope of the slot provides a positive capture mechanism similar but not equal to that provided by a transverse slot such as 24. The diagonal slot can be more easily manufactured in some constructions of the device than the two part slot of inner cone 6.

The construction of the device can be made of any of a variety of materials from aluminum or steel to injection molded plastic. The inner and outer cones 5 and 6 can be constructed from single molds. A teflon or nonstick coating may be applied to the outer peripheral surface 10 of the inner cone 6 and/or the inner peripheral surface 15 of the outer cone 5. Such a coating provides an additional means for the outer cone 5 to slip upwardly upon the inner cone 6 and trip the alarm in an attack on the edge of the node.

The shape and features of the conical sections of the node are critical in providing a secure system for protecting a network of computers or appliances. In the field of security devices, it has generally been found that potential thieves prefer to attack a device quickly through some type of physical force rather than the long process of picking a lock or solving a combination. The present invention provides an optical security system that is free from physical attack. Any attack of the optical fiber cable or the attachment devices at the nodes will result in the sounding of the alarm and will ward off any potential thief.

As can also be appreciated, other enhancements may be made to the overall system to improve functionality. For example, the system may employ an opto-electronic sensing device in control box 4 such as an optical time-domain reflectometer (OTDR), to permit the localization of any particular node along the fiber under attack. In such a system the optical fiber need not be in the form of a closed circuit, but may rather have only one end attached to the control box. OTDR's have the capability of detecting the location of disturbances in the optical fiber by means of a return signal from the disturbance, or by means of measuring changes in Rayleigh scattering along the length of a fiber. OTDR's do not require that the farthest end of the fiber be returned to the sensor.

Various conventional sensor technologies may be employed in control box 4 as well. The most common of these is a pulsed or otherwise modulated light source such as an LED as the emitting light source, and a phototransistor or photodiode with processing circuitry sensitive only to the emitted pulses of light. Such sensor technologies are common in the photoelectric sensing industry and are not novel.

Additional enhancements may include a manual sensitivity adjustment that permits the control box to be made extremely sensitive to bending, or so insensitive that only very sharp bends or breaks are detected.

Figure 10:
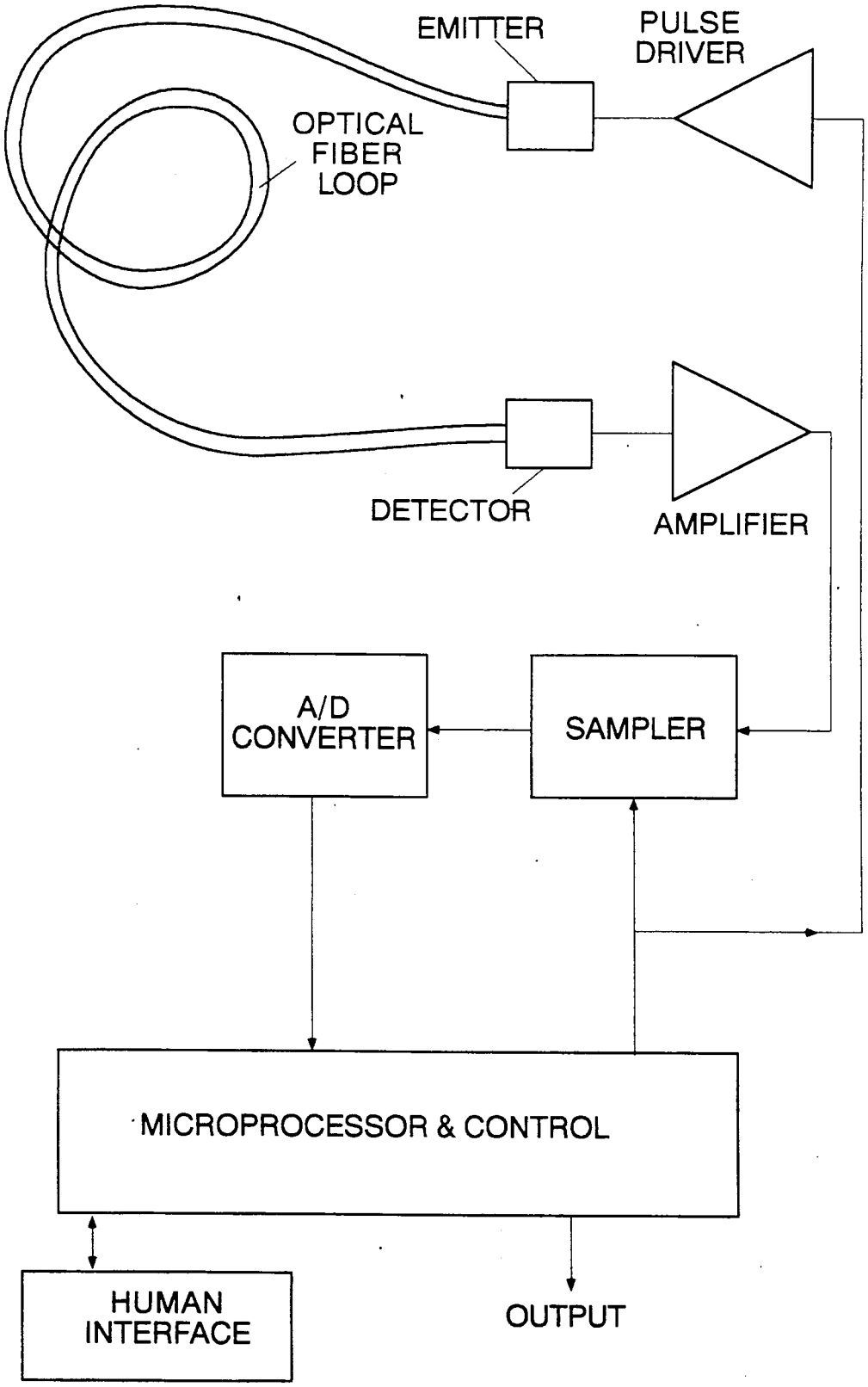
FIG. 10 shows a block diagram of the control circuitry of the optical security system shown in FIG. 1.

FIG. 10 shows a block diagram of an embodiment of the control circuitry used to control the fiber optic security system of FIG. 1. An emitter emits a repetitive pulse of light through the optical fiber loop which is subsequently received by a detector. In response to receiving a light pulse, the detector sends a signal to the microprocessor and control system via a sampler and A/D converter means. If the intensity of the received light pulses is attenuated due to the optical fiber being cut or bent, the microprocessor interprets the change and sounds an alarm.

For enhanced dynamic range and sensitivity, an optical sensor of a type such as those described in my U.S. Pat. Nos. 4,736,097 or 4,879,461 may be employed.

It should be apparent that many modifications could be made to the optical security system which would still be encompassed within the spirit of the present invention. It is intended that all such modifications may fall within the scope of the appended claims.

What is claimed is:

1. An optical security system for protecting an appliance comprising:

a conduit for transmitting light therethrough;

an attachment device for holding said conduit, said device comprising means for attaching said conduit to the appliance;

means for preventing removal of said conduit from said device without first bending said conduit, said preventing means not necessitating the breaking or feeding through of the conduit to facilitate removal of said conduit;

means for controlling said system, said controlling means comprising a means for sensing a disturbance of the light within said conduit, and a means for generating an alert signal in response to said sensing means;

wherein, said optical security system sends an alert signal in response to an attempt to remove said conduit from the appliance which results in a bending or breaking of said conduit and a subsequent disturbance of the light within said conduit.

2. An optical security system as claimed in claim 1, wherein, said attachment device further comprises means for allowing said conduit to move longitudinally within said device without bending said conduit to allow the appliance to be moved without activating said sensing means.

3. An optical security system as claimed in claim 1, wherein, said attachment device comprises first and second members, said first member attached to a surface of the appliance, said second member covering said first member and capturing said light conduit between said first and second members.

4. An optical security system as claimed in claim 1, wherein, said system comprises a plurality of said attachment devices, each of said plurality of devices capable of securing a separate appliance.

5. An optical security system as claimed in claim 1, wherein, said controlling means further comprises a means for sending and receiving light through said conduit to form a closed light circuit, said sensing means sensing a disturbance in said light circuit in response to one of two conditions, a first condition wherein said conduit is bent and a second condition wherein said conduit is severed.

6. An optical security system as claimed in claim 1, wherein, said controlling means modulates the light conducted into the conduit.

7. An optical fiber security attachment device for capturing an optical fiber cable of an optical security system and securing the fiber cable to an appliance, comprising:

a base member comprising means for attaching said base member to a surface of the appliance, said base member having a groove for capturing the optical fiber cable;

a cover member comprising means for substantially covering said base member, said cover member having a slot with first and second ends;

a means for preventing removal of the fiber cable from said attachment device without bending the fiber cable;

wherein, the optical fiber cable is securely held between said base member and said cover member by extending through said groove of said base member and exiting out of said first and second ends of said slot of said cover member.

8. An optical fiber security attachment device as claimed in claim 7, wherein, said groove of said first member extends radially into the center of said base member, said radial groove forming a longitudinal channel through said base member, said channel having first and second open ends at opposite sides of said base member;

said first and second ends of said slot of said cover member are in alignment with said first and second open ends of said groove of said base member, respectively;

wherein, the optical fiber cable is held within said channel of said groove of said base member and extends through said first and second ends of said slot of said cover member.

9. An optical fiber security attachment device as claimed in claim 8, wherein, said channel of said base member is of equal or greater width than the diameter of the optical fiber cable to allow the fiber cable to slide freely within said base and cover members.

10. A optical fiber security attachment device as claimed in claim 7, wherein, said base member is formed as a solid cone and said cover member is formed as a hollow cone that fits over said base member.

11. An optical fiber security attachment device as claimed in claim 10, wherein, said base member includes a cutout adjacent to the appliance, said cutout capable of receiving a fastener for attaching said base member to the appliance.

12. An optical fiber security attachment device as claimed in claim 11, wherein, said cover member includes a recess on an interior surface of said hollow cone, said recess for allowing a head of said fastener to extend above an exterior surface of said base member.

13. An optical fiber security attachment device as claimed in claim 7, wherein, said base member includes a cutout, said cutout allowing access to a fastener of the appliance when said cover member is removed from said base member.

14. An optical fiber security attachment device for attaching a flexible optical fiber cable to a surface, comprising:

a first member comprising attachment means for securing said first member to the surface, said first member having a means for holding the fiber cable and allowing the fiber cable to extend through said first member;

a second member comprising means for substantially covering said first member, said second member having a means for allowing the fiber cable to extend through said second member;

said means for allowing the fiber cable to extend through said first member is in alignment with said means for allowing the fiber cable to extend through said second member, said alignment defining a substantially linear passage;

wherein, said fiber cable is held between said first and second members, thereby attaching the fiber cable to the surface.

15. An optical fiber security attachment device, as claimed in claim 14, wherein, said device further comprising means for allowing the cable to slide freely within said passage.

* * * * *